United States Patent [19]

Montag et al.

[11] 4,350,757

[45] Sep. 21, 1982

[54] METHOD FOR MAKING VISIBLE RESIDUAL MOISTURE DISTRIBUTIONS IN PHOTOGRAPHIC WET FILM LAYERS SUBJECTED TO AN ONCOMING FLOW

[75] Inventors: Bernhard Montag, Forchheim; Gert Mages, Nuremberg; Heinrich Opitz, Erlangen, all of Fed. Rep. of Germany

[73] Assignee: Siemens Aktiengesellschaft, Munich, Fed. Rep. of Germany

[21] Appl. No.: 235,672

[22] Filed: Feb. 18, 1981

[30] Foreign Application Priority Data

Mar. 4, 1980 [DE] Fed. Rep. of Germany ..... 3008266

[51] Int. Cl.[3] ..... E03C 5/26

[52] U.S. Cl. ..... 430/422; 73/147

[58] Field of Search ..... 430/422, 435, 445; 73/147, 168, 432 R

[56] References Cited

U.S. PATENT DOCUMENTS

| | | | |
|---|---|---|---|
| 2,740,713 | 4/1956 | Warren | 430/422 |
| 3,345,174 | 10/1967 | Dotson et al. | 430/422 |
| 4,250,249 | 2/1981 | Montag | 430/355 |
| 4,259,431 | 3/1981 | Opitz | 430/199 |

*Primary Examiner*—Mary F. Downey

*Attorney, Agent, or Firm*—Kenyon & Kenyon

[57] ABSTRACT

The invention relates to a method for making visible by photochemical means residual moisture distributions in photographic wet film layers subjected to a gas flow. According to the invention, a film diffusely pre-exposed is immersed in an aqueous swelling agent solution which contains either (a) a reducing agent or (b) an alkali. After being exposed to the air stream, the invisible residual moisture profile is immersed in an alcoholic solution of either (a) an alkali or (b) a reducing agent. The half-tone image produced serves for determining stationary local boundary layer thickness distributions, wall shearing stresses, material transfer coefficients and heat transfer coefficients.

4 Claims, No Drawings

METHOD FOR MAKING VISIBLE RESIDUAL MOISTURE DISTRIBUTIONS IN PHOTOGRAPHIC WET FILM LAYERS SUBJECTED TO AN ONCOMING FLOW

BACKGROUND OF THE INVENTION

The present invention relates to a method for photochemically making visible residual moisture distributions in photographic wet film layers subjected to an oncoming flow, by applying a swelled photographic film to the surface subjected to the flow, by conducting a gas over it and by subsequent development of a residual moisture photogram by means of photographic developers.

According to known methods, residual moisture distributions in photographic wet film layers subjected to a flow can be made visible by photochemical means. The wet film diffusion method is based on the conversion of residual moisture profiles in films exposed to a flow into half-tone blackening profiles analogous to moisture. The development can be accomplished by sulfide seeding or by post-exposure. With post-exposure, the photographic developer subsequently incorporated in the film generates silver half-tone images analogous to moisture at points of the residual moisture profile. Dry points on the film remain bright (see U.S. Pat. No. 3,774,225). The post-exposure method and the sulfide seeding method are disturbed by the effect of daylight and must, therefore, be carried out under dark room conditions. In order to be able to work in daylight, it is necessary to convert the residual moisture profile of the exposed wet film into a brown silver sulfide image in a mixture of hydrogen sulfide and air according to the so-called hydrogen sulfide method ("Sulfide Seeding Method"). This requires not only fairly large amounts of hydrogen sulfide gas, but also very accurately defined gas mixtures, which are difficult to prepare, for the quantative densitometric evaluation of the silver sulfide half-tone photograms.

For improving these methods it has been proposed in commonly-assigned U.S. Ser. No. 936,948 now U.S. Pat. No. 4,250,249 to first immerse the film exposed to the gas stream in an alcoholic (ethanolic) sodium hydroxide solution (Bath 1—alkalizing the residual moisture remaining in the film). After removing residual liquid on the film surface by means of a calender, the film is subsequently immersed in a neutral aqueous solution with a reducing agent suitable as a photographic developer, for example, hydroquinone (Bath 2). Silver development takes place only at the alkali-containing points of the film. This method, which works successfully in daylight, requires that the operating temperatures of the baths be kept constant.

SUMMARY OF THE INVENTION

It is an object of the present invention to provide a method for simplifying the development of residual moisture half-tone photograms according to the wet film diffusion method.

According to the present invention, this and other objects are attained by the provision of a process wherein a film pre-exposed diffusely in daylight is placed, up to the point of saturation of its gelatin layer, in an aqueous swelling agent solution which contains (a) a reducing agent or (b) an alkali material, and that the film, after exposure to an air stream, is immersed (a) in an alcoholic alkali solution or (b) in an alcoholic solution of a reducing agent. Since the reducing agent or the alkali is added to the swelling bath at the start, a special treatment step is obviated.

Preferably suited as swelling agent solutions are water-glycol mixtures having a glycol content of 10 to 50 percent by volume.

Useful as reducing agents in the swelling agent solution are the water-soluble developers such as amidol (2,4-diaminophenol, hydrochloride), pyrocatechol, edinol, eiconogen, glycine, hydramine, hydroquinone, chlorohydroquinone (Adurol), bromohydroquinone (Adurol), metol, neol, phenidone, o-phenylenediamine, p-aminophenol(hydrochloride), p-phenylenediamine, pyrogallol and sulfinol in concentrations of 1 to 10 percent by weight, referred to the water component.

Useful as the alkali material in the swelling agent solution is any water-soluble alkali such as $K_2CO_3$, $Na_2CO_3$, trisodium phosphate, sodium metasilicate (Metso), triethanolamine, sodium metaborate, neutral sodium pyrophosphate, barium carbonate, codalk, borax and sodium sulfite, especially NaOH and KOH. The concentrations are between 1 and 10 percent by weight referred to the water component. The pH-value of the swelling agent solution is between about 9 and 13.

Particularly suitable photographic developer solutions are alcohol/water mixtures having a water content of up to 4 percent by volume.

Useful as the reducing agent in the developer solution is any developer which is easily soluble in alcohol such as pyrocatechin and p-phenylenediamine, particularly hydroquinone. The concentration of these agents in the solution is between 1 and 5 percent by weight and the operating temperature of the solution is between about 15° and 30° C.

Alkalis suitable in the developer solution are alkalis soluble in alcohol such as $Na_2CO_3$ and triethanolamine and particularly NaOH and KOH, as well as the lower alcoholates of potassium and sodium such as sodium and potassium methylate and ethylate. The concentration of the solution is between 1 and 5 percent by weight at working temperatures between about 15° and 30° C.

The immersion times of the exposed films in the developer solutions are between about 10 and 300 sec.

To carry out the method according to the invention, a film diffusely pre-exposed in daylight is swelled, up to saturation, for about 3 to maximally 20 minutes in an aqueous swelling agent solution containing a reducing agent or an alkali. After the film has swelled up, the swelling agent residues remaining on the film surface after the film has been removed from the solution are removed by wiping or squeezing off by means of a calender. Subsequent to exposure in the flowing air stream, the film, now provided with the invisible residual moisture profile, is immersed in the single-bath developer solution which contains an alkali or a reducing agent, depending on the composition of the swelling agent. According to the residual moisture content in the film, a visible black and white silver half-tone image is now produced. After completion of the development, the film is freed of developer liquid residue by squeezing so as to avoid the development of spots during the subsequent fixation process. After the fixation, the film is rinsed and dried as usual.

The method according to the present invention is particularly well suited for determining stationary local boundary layer thickness distributions, wall shearing stresses, material transfer coefficients and heat transfer coefficients.

DETAILED DESCRIPTION OF THE INVENTION

The invention is explained in further detail with reference to the following illustrative examples:

EXAMPLE 1

A photographic film sheet (AGFA N33p) is swelled for five minutes in a swelling agent solution at a temperature of 20° C. The swelling agent solution consists of a water/glycol mixture in the ratio of 1:1 with an addition of 2 percent by weight hydroquinone. After the swelling, liquid residues remaining on the film are removed by squeezing them off by means of a calender. The swelled film then is applied to the surface subjected to the flow and is exposed to the air stream. After an exposure time of several minutes, the film, which now is provided with the invisible residual moisture profile, is removed from the surface of the object exposed to the flow and is immersed in the single-bath developer solution. The developer solution consists of an alcohol/water mixture with a water content of 4 percent by volume and an addition of 2 percent by weight NaOH. The developing time is 3 minutes at a temperature of 20° C. According to the residual moisture content in the film, a visible black and white silver half-tone image is produced. To avoid the formation of spots, liquid residues on the film remaining after the development are removed by squeezing by means of a calender. The film is subsequently fixed, rinsed and dried.

EXAMPLE 2

A photographic film sheet (AGFA N33p) is swelled in daylight in a swelling agent solution for five minutes at a temperature of 20° C. The swelling agent solution consists of a water/glycol mixture in the ratio of 1:1 and an addition of 5 percent by weight KOH. After the swelling, liquid residues remaining on the film are removed by squeezing. The swelled film then is applied to the surface to be exposed to the flow and is exposed to the air stream. After an exposure time of several minutes the film, which now is provided with the invisible residual moisture profile, is removed from the surface of the object exposed to the flow and is immersed in the single-bath developer solution. The developer solution consists of water-free alcohol with an addition of 2 percent by weight hydroquinone. The development time is 5 minutes at a temperature of 20° C. According to the residual moisture content in the film, a visible black and white silver half-tone image is produced. To avoid the development of spots, liquid residues remaining on the film after the development are removed by squeezing by means of a calender. Subsequently the film is fixed, rinsed and dried.

What is claimed is:

1. A method for making visible by photochemical means residual moisture distributions in photographic wet film layers exposed to flow, comprising:

(a) providing a silver halide-containing photographic film diffusively pre-exposed in daylight;

(b) placing said film in an aqueous swelling agent solution until the gelatin layer of said film is saturated, said swelling agent solution containing a member selected from (1) a reducing agent and (2) an alkali material;

(c) applying said swelled film to a surface;

(d) exposing said surface having said swelled film thereon to a flow to obtain invisible residual moisture distributions in said film;

(e) immersing said film in a solution selected from (1) a substantially water-free alcoholic alkali solution where the swelling agent solution of step (b) contains a reducing agent, and (2) a substantially water-free alcoholic solution of a reducing agent where the swelling agent solution of step (b) contains an alkali material, so as to make visible said moisture distributions.

2. The method according to claim 1 wherein said swelling agent solution comprises a water/glycol mixture having a glycol content of from about 10 to 50 percent by volume and which contains from about 1 to 10 percent by weight of a reducing agent, referred to the water content.

3. The method according to claim 1 wherein said swelling agent solution comprises a water/glycol mixture having a glycol content of from about 10 to 50 percent by volume and which contains from about 1 to 10 percent by weight water-soluble alkali, referred to the water content.

4. The method according to claims 1, 2 or 3 wherein said film diffusely pre-exposed in daylight is immersed for about 5 minutes in the swelling agent solution.

* * * * *